United States Patent [19]

Deutsch

[11] Patent Number: 4,468,996

[45] Date of Patent: Sep. 4, 1984

[54] NOTE GROUP SELECTABLE MUSICAL EFFECTS IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 462,254

[22] Filed: Jan. 31, 1983

[51] Int. Cl.[3] ..... G10H 1/02; G10H 1/06; G10H 7/00

[52] U.S. Cl. ..... 84/1.01; 84/1.22; 84/1.24; 84/1.25

[58] Field of Search ..... 84/1.01, 1.03, 1.19–1.25

[56] References Cited

U.S. PATENT DOCUMENTS 4,357,851 11/1982 Markowitz et al. ..... 84/1.01

4,375,178 3/1983 Whitefield ..... 84/1.25

*Primary Examiner*—Stanley J. Witkowski

*Attorney, Agent, or Firm*—Ralph Deutsch

[57] ABSTRACT

A keyboard operated electronic musical instrument is disclosed which has a number of tone generators that are assigned to actuated keyswitches. Logic is provided for generating a note range signal for each preselected group of contiguous keyswitches in which the note range signal is selected for an actuated keyswitch. Musical effects such as vibrato and tone changes are selectively actuated in response to the note range signal. A mixture tone generator is described which uses a single set of harmonic coefficients which are translated and shifted in response to the note range signal.

15 Claims, 12 Drawing Figures

MIXTURE 1:2,1 3/5,2
MIXTURE 2:2 2/3,2,1 3/5
MIXTURE 3:4,2 2/3,2
MIXTURE 4:4,2 2/3

MIXTURE 1
MIXTURE 2
MIXTURE 3
MIXTURE 4
DB
-20
-40
2 4 6 8 10 12 14 16
HARMONICS

NOTE GROUP SELECTABLE MUSICAL EFFECTS IN AN ELECTRONIC MUSICAL INSTRUMENT

BACKGROUND OF THE INVENTION

1. Field of the Invention

This invention relates to electronic musical tone synthesis and in particular is concerned with the implementation of musical effects which change as a function of the musical octave.

2. Description of the Prior Art

Electronic keyboard operated musical instruments without the addition of certain auxiliary systems tend to generate each tone with a mechanical-like precision and sameness in response to each actuated keyboard switch. This precision and similarity of tone is in sharp contrast with tones produced by conventional orchestral acoustic musical instruments. Almost none of these acoustic musical instruments creates all its tones in a precise replica of each other as the fundamental pitch changes. Even a mechanical tone generator such as a pipe organ is carefully designed so that each individual pipe in a rank of pipes has its own individual attack/decay/-release envelope as well as its own individual loudness and characteristic tone. Each of these individual characteristics is different for each pipe in the rank of pipes.

Several auxiliary subsystems have been incorporated into the implementation of electronic musical instruments to vary the generated tone character over the pitch range associated with the keyboard. In U.S. Pat. No. 3,610,805 entitled "Attack And Decay System For A Digital Organ" a system is disclosed in which the timing of the attack and release phases of an ADSR (attack/decay/sustain/release) envelope modulation function are varied by counting the number of half-cycles of the fundamental period of the corresponding generated musical tone. In this fashion each note on the keyboard is generated with its own individual ADSR envelope timing. The disclosed system has a negative characteristic attribute caused by a timing logic such that when the ADSR timing is adjusted for the middle range of the keyboard it is perceived that the low octave notes have a very slow and unnatural sluggish attack and release while the high octave notes have such a fast attack that the tone appears to be purely percussive with almost no perseptive attack phase.

In U.S. Pat. No. 4,214,503 entitled "Electronic Musical Instrument With Automatic Loudness Compensation" a system is disclosed for producing a constant loudness level for all generated notes by automatically applying an ADSR envelope level compensation for equalizing the frequency sensitivity of hearing as quantified by the Fletcher-Munson constant loudness curves.

Organs designed to be used in the rendition of classical and liturgical music generally contain stops having the generic name of "mixtures." Mixtures are a heritage derived from early pipe organ design. The mixtures were employed originally to provide higher harmonics to be added to pipes limited to diapason type tones which are characterized by a fairly limited number of harmonics in their tonal structure. The introduction of mixture stops to extend the limited harmonic structure of diapason tones occurred before organ pipe designers learned techniques for producing sounds with extended harmonics for pipes in the string and reed families of tones.

A mixture stop generally consists of three or four ranks of pipes which all have elements that sound simultaneously with each actuated keyboard switch. The mixtures are usually constituted from ranks of diapason type voices. A typical mixture tone changes in each octave by selecting combinations of pipe footages. An example of such of the footages of ranks combined for each selected keyboard range is $C_2$-$B_2$: 2′, 1 3/5′, 1′
$C_3$-$B_3$: $2\frac{2}{3}$′, 2′, 1 3/5′
$C_4$-$B_4$: 4′, $2\frac{2}{3}$′, 2′
$C_5$-$C_7$: 4′, $2\frac{2}{3}$′.

Electronic organs usually implement mixture stops by a system of either mechanical or electrical unification of a single diapason voice tone generators. This method of unification to produce a mixture stop produces somewhat objectionable temperament beats which result from the unification technique of actuating the nearest true musical notes for the mutation footages of $2\frac{2}{3}$′ and 1 3/5′ instead of generating the tones of the true third and fifth harmonic of the actuated keyboard tone switch.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created using a selected set of harmonic coefficients whose selection is responsive to actuated keyboard switches. At the end of each computation cycle, the computed master data set is stored in a main register.

Following each individual computation cycle, a transfer cycle is initiated during which the stored master data set is transferred to a note register corresponding to an associated actuated keyboard switch. The data stored in a note register is sequentially read out to a digital-to-analog converter at a rate corresponding to the fundamental tone associated with its assigned actuated keyboard switch. The output tone generation continues uninterrupted during the computation and transfer cycles.

It is an object of the present invention to implement musical effects which change as a function of the keyed octave or at a given note within an octave.

It is a further object of the present invention to provide a mixture voice generator using a single set of stored harmonic coefficients.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator in which musical effects are determined by the octave in which a keyswitch is actuated. The tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
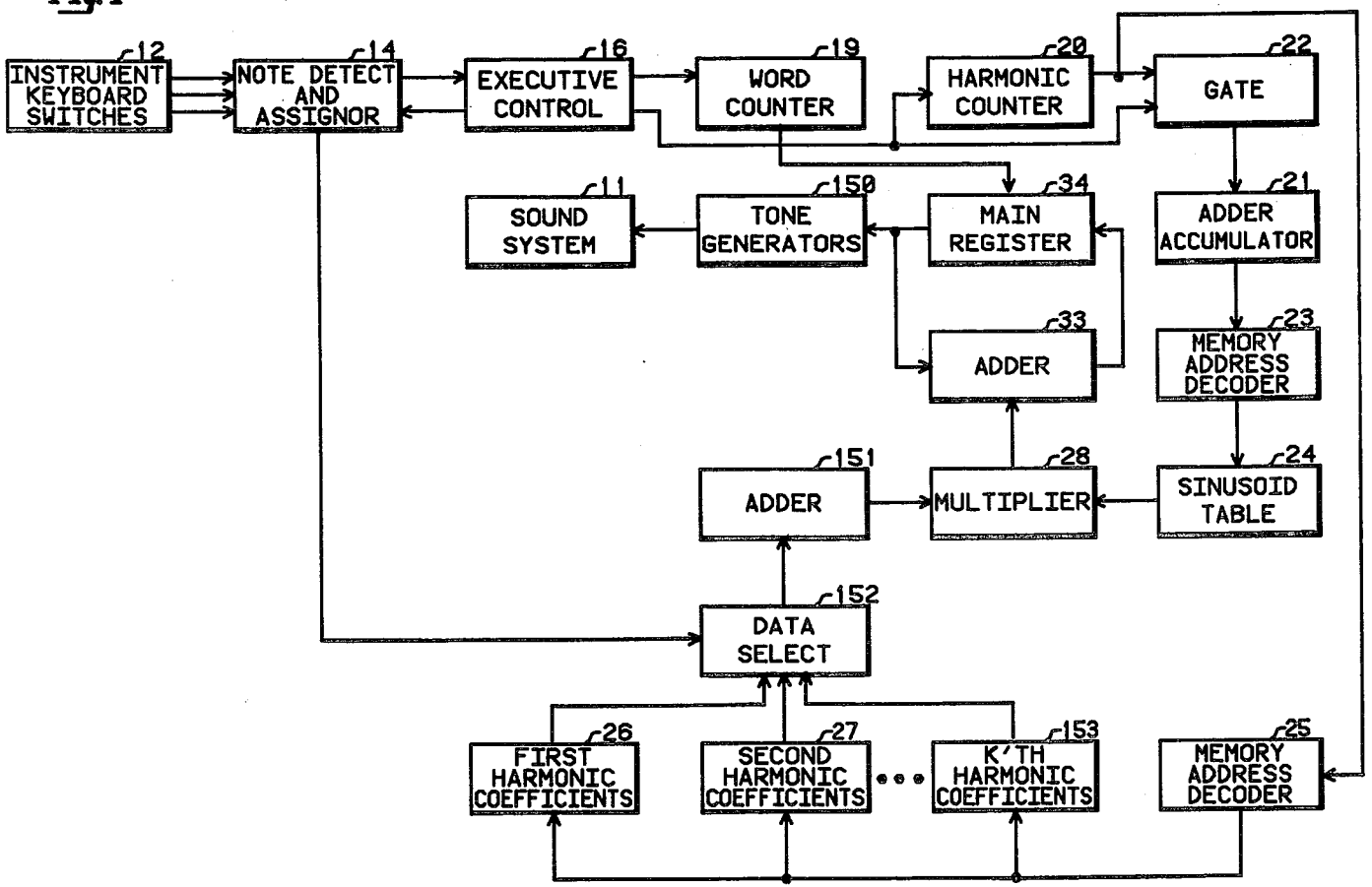
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches 12. The keyboard switches are arranged in groups which generally correspond to musical octaves. If one or more of the keyboard switches have a switch status change and are actuated ("on" position) on the instrument's keyboard, the note detect and assignor 14 encodes the detected keyboard switch and stores the corresponding note information for the actuated keyswitches and one member of the set of tone generators 150 is assigned to each actuated keyswitch. A suitable note detect and assignor subsystem is described in U.S. Pat. No. 4,022,098 which is hereby incorporated by reference. The note detect and assignor 14 acts as a keyswitch state detect means.

When one or more keyswitches on the keyboards have been actuated, the executive control 16 initiates a repetitive sequence of computation cycles. A computation cycle in this repetitive sequence of computation cycles is associated with each actuated keyswitch. During each computation cycle, a master data set consisting of 64 data words, or points, is computed in a manner described below and stored in the main register 34. The 64 data words in the master data set are generated using 32 harmonic coefficients that are stored in the harmonic coefficient memories 26, 27, . . ., 153. The selection of a particular set of harmonic coefficients is determined by the data select 152 in response to data provided by the note detect and assignor 14.

The 64 data words in the master data set correspond to the amplitudes of 64 equally spaced points of one cycle of the audio waveform for the musical tone produced by a corresponding one of the tone generators 150. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the repetitive sequence of computation cycles, a transfer cycle is initiated during which the master data set residing in the main register 34 is transferred to a note register which is a system component of each of the tone generators contained in the system block labeled tone registers 150.

The master data set stored in a note register is read out sequentially and repetitively and transferred to a digital-to-analog converter at a rate determined by a note clock associated with the note register. The note clock timing signals correspond to the fundamental frequency of the musical note associated with the actuated keyswitch to which the corresponding tone generator has been assigned by the note detect and assignor 14.

The note clock can be implemented in any of a wide known variety of possible adjustable frequency timing clocks. Advantageously the note clocks can be implemented as voltage controlled oscillators. One such implementation in the form of voltage controlled oscillators is described in detail in U.S. Pat. No. 4,067,254 which is hereby incorporated by reference.

A digital-to-analog converter is contained in the system block labeled sound system 11. The musical waveshape is transformed into an audible sound by means of a sound system consisting of a conventional amplifier and speaker subsystem which are also contained in the system block labeled sound system 11.

As described in the referenced U.S. Pat. No. 4,085,644 it is desirable to be able to continuously recompute and store the generated master data sets during a repetitive sequence of computation cycles and to load this data into the associated note registers while the actuated keys remain actuated, or depressed, on the keyboards.

In the manner described in the reference U.S. Pat. No. 4,085,644, the harmonic counter 20 is initialized to its minimal, or zero, count state at the start of each computation cycle. Each time that the word counter 19 is incremented so that it returns to its initial, or minimal count state because of its modulo counting implementation, a signal is provided which increments the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 words.

At the start of each computation cycle, the adder-accumulator 21 is initialized to a zero value. Each time that the word counter 19 is reset to its minimal count state, the accumulator is reset to a zero value. Each time that the word counter 19 is incremented, the accumulator adds the current count state of the harmonic counter 20 to the sum contained in the accumulator. This addition is implemented to be modulo 64.

The content of the accumulator in the adder-accumulator 21 is used by the memory address decoder 23 to address out trigonometric sinusoid values from the sinusoid table 24. The sinusoid table 24 is advantageously implemented as a read only memory storing values of the trigonometric function $\sin(2\pi\phi/64)$ for $0 \leqq \phi \leqq 64$ at intervals of D. D is a table resolution constant.

The multiplier 28 multiplies the trigonometric value read out of the sinusoid table 24 by harmonic coefficients provided by the adder 15 that are read out of the harmonic coefficient memories in responses to addresses provided by the memory address decoder 25. The memory address decoder 25 provides a memory address corresponding to the count state of the harmonic counter 20. The product value formed by the multiplier 28 is furnished as one input to the adder 33.

The contents of the main register 34 are initialized to a zero value at the start of a computation cycle. Each time that the word counter 19 is incremented, the contents of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 completes count cycles of 64 counts, the main register 34 will contain the master data set corresponding to a selected one of the actuated keyboard switches. In this manner each actuated keyswitch can be assigned a tone color in a fashion described below.

The note detect and assignor 14 contains a memory in which the keyboard, octave, and musical note data is encoded and stored for each detected actuated keyboard switch. As each computation cycle is started for a given tone generator assigned to an actuated keyboard switch, the corresponding octave information is transmitted to the data select 152. There is a different set of harmonic coefficients stored in the set of harmonic coefficient memories 26, 27, . . ., 153. The data select 152 selects the data values accessed from these memories by the memory address decoder 25 according to the octave data signal provided by the note detect and assignor 14. In this fashion the generated tone colors are changed depending upon the octave in which a note is played on the keyboard.

Figure 2:
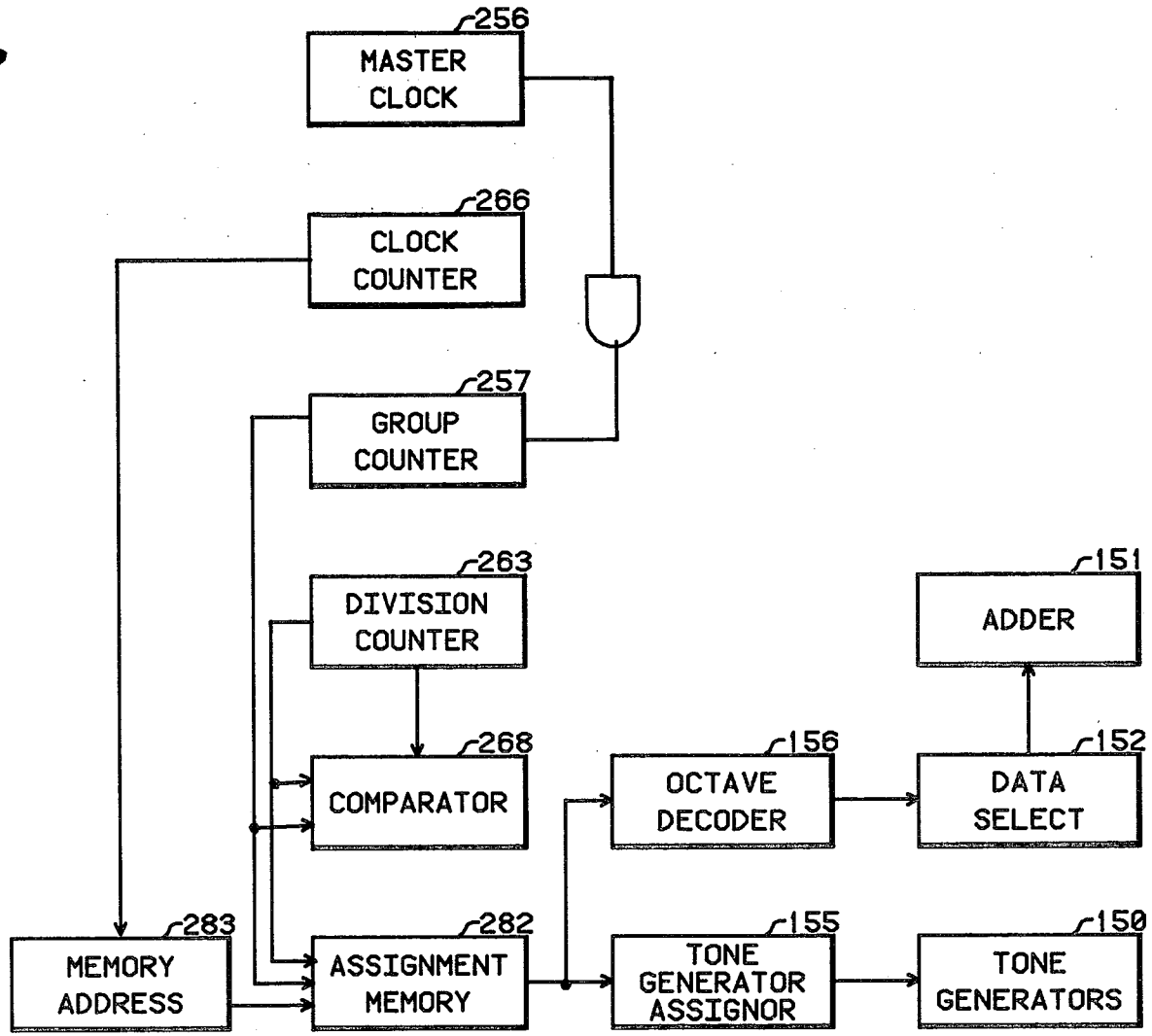
FIG. 2 is a schematic diagram of the octave data generating system.

FIG. 2 shows the details of the logic for providing the octave signal data to the data select 152. The logic shown is a modification to the logic shown in FIG. 2 of U.S. Pat. No. 4,022,098. The blocks labeled in the 200 number series are 200 plus the same labeled blocks shown in FIG. 2 of the referenced patent. The data read out from the assignment memory 282 by the memory address 283 is used by the tone generator assignor 155 to assign one of the tone generators in the set of tone generators 150 to a corresponding actuated keyboard switch. The same data read out from the assignment memory 282 is decoded by the octave decoder 156 to provide octave data which is provided to the data select 152.

Figure 3:
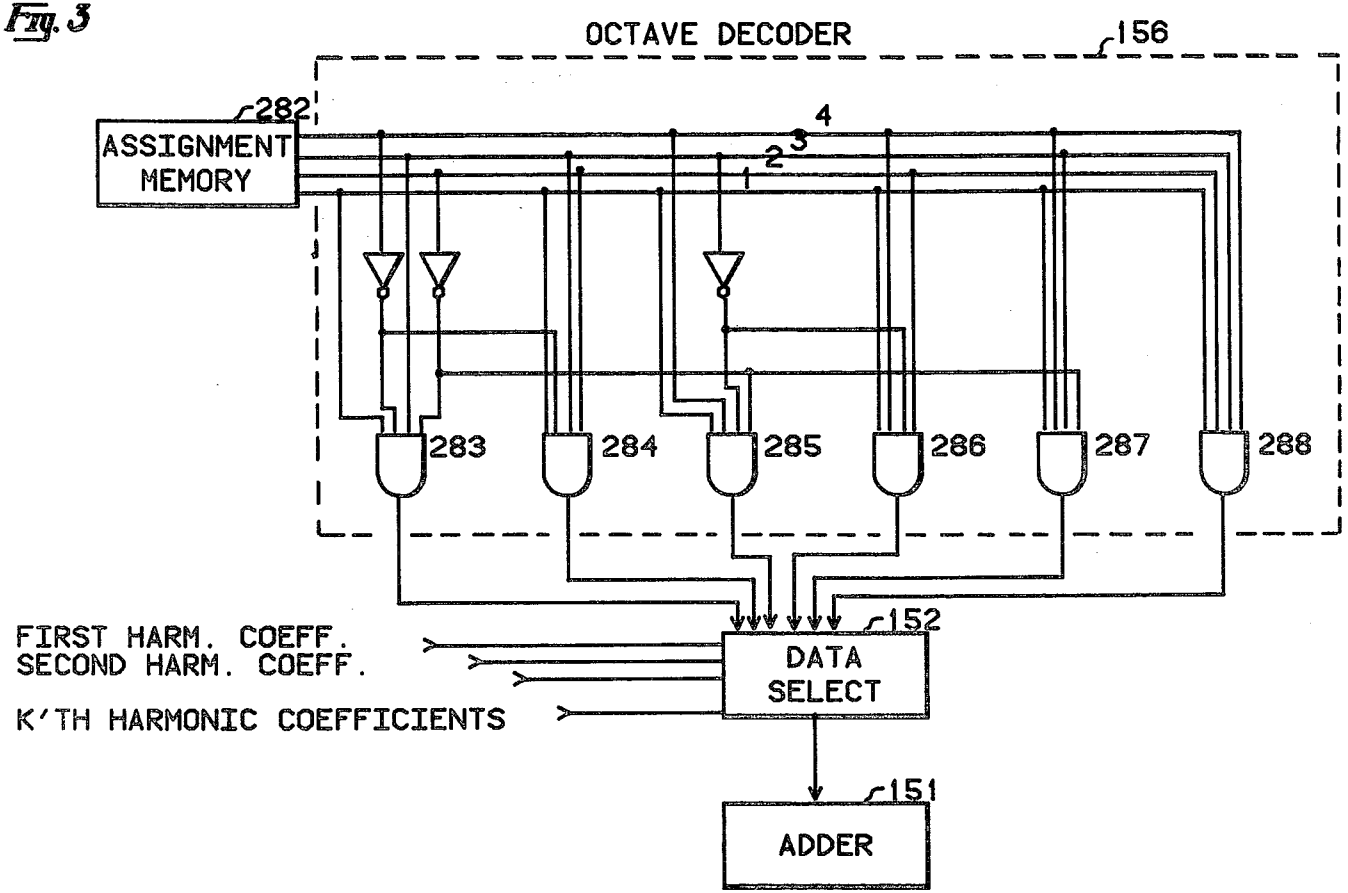
FIG. 3 is a schematic diagram of the octave decoder and data select system blocks.

FIG. 3 shows the logic details of the octave decoder 156 and the data select 152. As described in the referenced U.S. Pat. No. 4,022,098 the assignment memory 282 is a read-write memory containing data words which represent the current assignment status of each member of the set of tone generators 150. Each of these data words comprises 10 bits. The LSB (least significant bit) denotes the assignment status of the tone generator corresponding to that data word. The LSB will be a binary "1" if the associated tone generator has been assigned to an actuated keyswitch. Bits 2, 3, and 4 are used to designate the octave in which the keyswitch has been actuated. Table 1 lists the octave coding data.

TABLE 1

| | Bits: | | | |
|---|---|---|---|---|
| Octave | 4 | 3 | 2 | Note Range |
| 2 | 0 | 1 | 0 | $C_2$–$B_2$ |
| 3 | 0 | 1 | 1 | $C_3$–$B_3$ |
| 4 | 1 | 0 | 0 | $C_4$–$B_4$ |
| 5 | 1 | 0 | 1 | $C_5$–$B_5$ |
| 6 | 1 | 1 | 0 | $C_6$–$B_6$ |
| 7 | 1 | 1 | 1 | $C_7$ |

The set of AND-gates 283–288 decode bits 2, 3 and 4 into an octave signal. The octave signal is a special case of the more general case of a note range signal which may not be limited to octave keyswitch group ranges. The decoded octave signals are not generated unless a tone generator has been assigned to an actuated keyswitch. While the signal lines from the harmonic coefficient memories are shown as single lines, it is understood that this is a drawing abbreviation to represent a set of lines that are sufficient to convey the binary bit information representing a harmonic coefficient. The data select 152 selects the output data read from a harmonic coefficient memory in response to the decoded octave signal by means of select logic gates.

Figure 4:
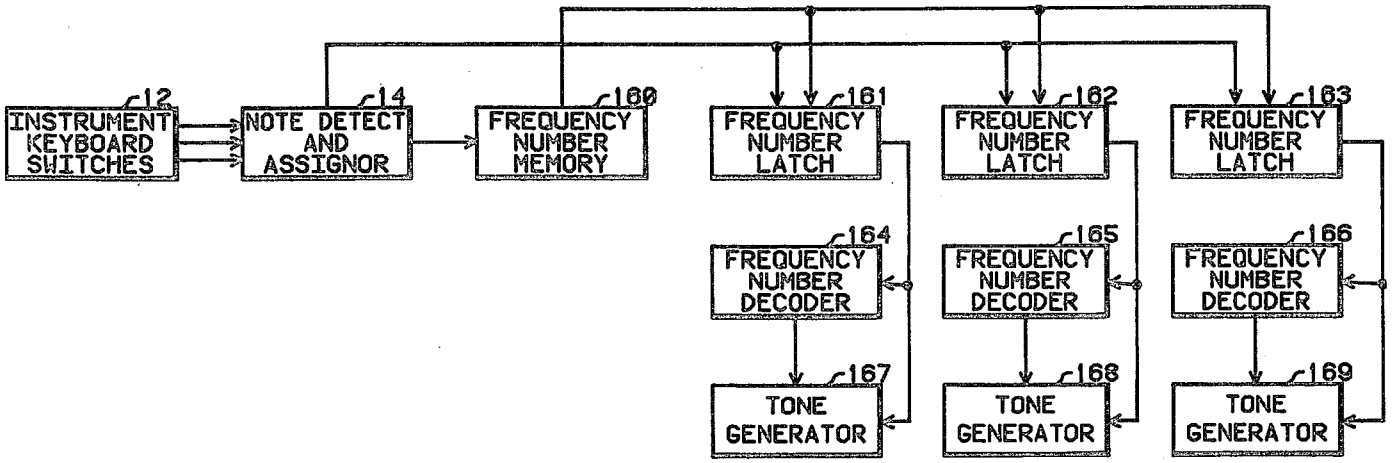
FIG. 4 is a schematic diagram of a note number tone select logic.

Instead of changing the tone color at the start of an octave it may be desirable to effect the tone changes at some other note rather than the start octave note of C. For example, the note F# is frequently chosen as the note at which tone color changes are effect such as for mixture voice. A method of implementing such tone color changes is shown in FIG. 4 for a tone generating system in which the fundamental frequency is determined by assigning a frequency number to each actuated keyboard switch. Such a system is described in the referenced U.S. Pat. No. 4,067,254.

Table 2 lists the note, frequency, decimal frequency number, and binary frequency number for notes in the vicinity of the octave change for the note C and a desired tone transition at the note F#.

TABLE 2

| Note | Frequency | Frequency Number | Binary Number | | | | |
|---|---|---|---|---|---|---|---|
| C#7 | 2217.46 | 1.0 | | | — | | |
| C7 | 2093.00 | 0.9438743127 | 0.111 | 100 | 011 | 010 | 001 |
| G6 | 1567.98 | 0.7071067813 | 0.101 | 101 | 010 | 000 | 010 |
| F#6 | 1479.98 | 0.6674199271 | 0.101 | 010 | 101 | 101 | 110 |
| F | 1396.91 | 0.6299605250 | 0.010 | 110 | 101 | 000 | 001 |
| C6 | 1046.50 | 0.4719371563 | 0.011 | 110 | 001 | 101 | 000 |
| G5 | 783.99 | 0.3535533906 | 0.010 | 110 | 101 | 000 | 001 |
| F#5 | 739.99 | 0.3337099636 | 0.010 | 101 | 010 | 110 | 111 |
| F5 | 698.46 | 0.3149802625 | 0.001 | 011 | 010 | 100 | 000 |
| C5 | 523.25 | 0.2359685782 | 0.001 | 111 | 000 | 110 | 100 |
| G4 | 391.80 | 0.1767766953 | 0.001 | 011 | 010 | 100 | 000 |
| F#4 | 370.00 | 0.1668549818 | 0.001 | 010 | 101 | 011 | 011 |

TABLE 2-continued

| Note | Frequency | Frequency Number | Binary Number | | | | |
|---|---|---|---|---|---|---|---|
| F4 | 349.23 | 0.1574901313 | 0.000 | 101 | 101 | 010 | 000 |

It is noted from the entries in Table 2 that the five bit sequence 10101 as a group identifies the frequency number corresponding to the note F# for any of the octaves. The number of zeroes preceding this five bit sequence is indicative of the octave in which a particular note F# is associated.

FIG. 4 shows a subsystem logic for assigning sets of harmaonic coefficients to be used in the computation of master data sets for associated tone generators depending upon the magnitude of the assigned frequency number in relation to the octave note F#.

As described in the referenced U.S. Pat. No. 4,067,254, in response to each detected actuated keyboard switch, the note detect and assignor 14 accesses a corresponding frequency number from the frequency number memory 160. The accessed frequency number is stored in one of the set of frequency latches 161–163 corresponding to the assigned tone generator. While only three frequency number latches are shown in FIG. 4, it is to be understood that there is a frequency number latch for each of the available plurality of tone generators in the tone generation system.

The frequency number memory 160 is a read-only addressable memory containing data words in digital binary form having values $2^{-(M-N)/12}$ where N has the range of values N=1,2, . . ., M and M is equal to the number of keyswitches on the musical instrument's keyboard. The frequency numbers represent the ratios of the fundamental frequencies in an equal tempered musical scale. A detailed description of frequency numbers is contained in U.S. Pat. No. 4,114,496 entitled "Note Frequency Generator For A Polyphonic Tone Synthesizer" which is hereby incorporated by reference.

Figure 5:
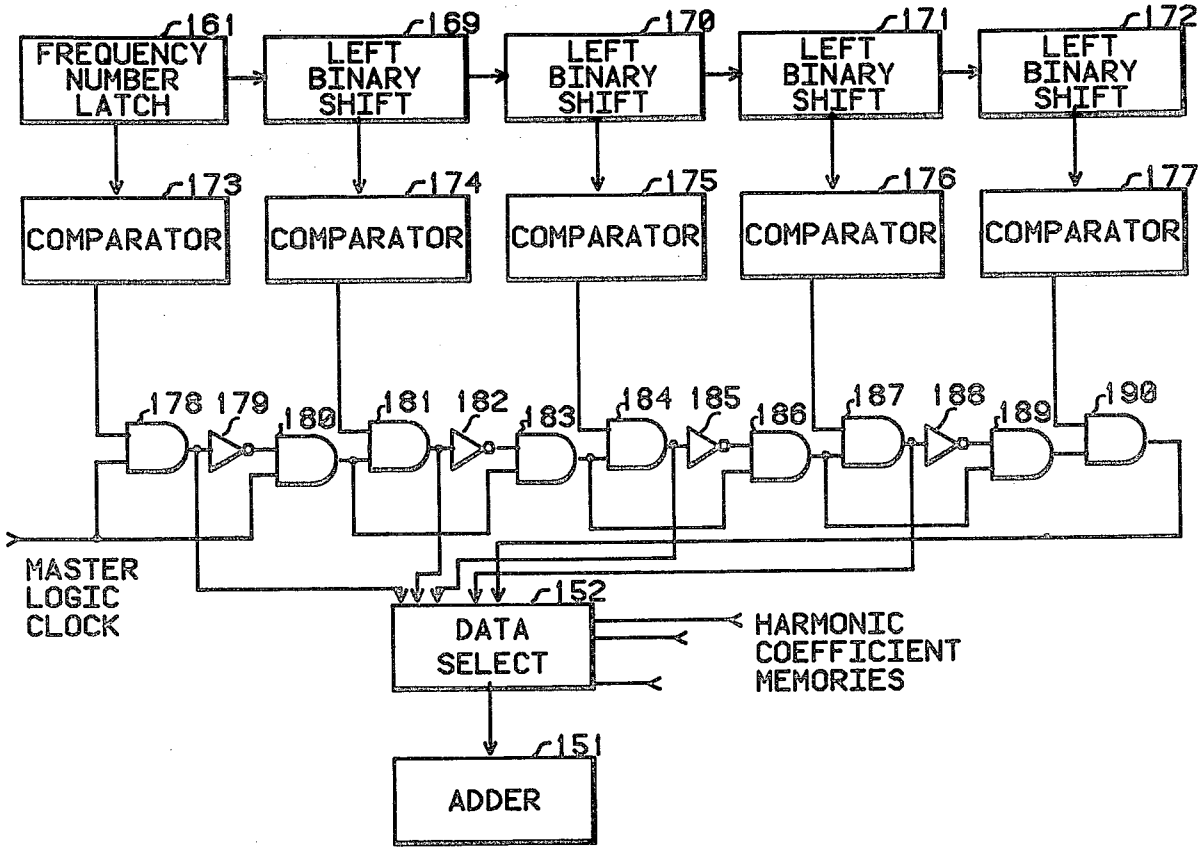
FIG. 5 is a schematic diagram of the frequency number decoder 164.

The frequency number decoders 164–166 decode the frequency numbers stored in their associated frequency number latch. The details of a frequency number decoder is shown in FIG. 5.

The frequency number stored in the frequency number latch is left shifted by one binary bit in turn by the set of left binary shifts 169–172. These constitute a set of frequency number scalers which multiply the input frequency numbers by preselected scale factors. In this case the scale factors are all chosen as the value $\frac{1}{2}$. Thus the output from the left binary shift 172 is a 4 bit left shifted version of the frequency number stored in the frequency number latch 161.

The comparator 173 will generate a "1" logic binary state if the five most significant bits of the frequency number stored in the frequency number latch 161 is greater or equal to the value of the selected bit sequence 10101. Such a "1" state signal indicates that the actuated keyswitch corresponds to a note equal in frequency or higher in frequency than the note F#6. The "1" state signal is generated by the comparator if the magnitude of the difference between the scaled input frequency number and the preselected frequency comparison number 1101 is less than a preselected comparison accuracy number.

The comparator 174 will generate a "1" logic binary state if the five most significant bits of the frequency number stored in the frequency number latch 161 after a one bit left binary shift is greater or equal to the value of the selected bit sequence 10101. Such a "1" state signal indicates that the actuated keyswitch corresponds to a note equal in frequency or higher in frequency than the note F#5.

The remainder of the left binary shifters and their associated comparators operate in an analogous fashion to that already described for comparators 173 and 174. Thus the comparator 175 will produce a "1" signal if the actuated keyswitch corresponds to a note equal in frequency or higher in frequency that the note F#4. The comparator 176 will produce a "1" state signal if the actuated keyswitch corresponds to a note equal to or higher than the frequency of the note F#3; the comparator 177 will produce a "1" state signal if the actuated keyswitch corresponds to a note equal to or higher than the frequency of the note F#2.

The logic comprising the AND-gates 178,180,181,183,184,186,187,189, and 190 and the inverters 179,182,185,188 act as a priority select logic. This priority furnishes a "1" signal to the data select from the lowest numbered comparator that generates a "1" signal. In this fashion the data select will select the harmonic coefficients for the highest octave in which a match has been made for the comparison select sequence of 10101. The signals provided to the data select 152 are called note select signals or note range signals. It is evident that the note range signals can readily be generated for other designated selected notes rather than F# which was used as an illustrative example. The system is readily extended to generate note range signals for situations in which the keyboard switches are not considered to be limited to octave groups but may be grouped in any desired set of notes.

Instead of simply using the octave select, or note select, signals to govern the selection of sets of harmonic coefficients, these signals can readily be employed to control a wide variety of musical tone generation effects. It is an obvious system implementation, using the present invention, to use the note or range signals to control a vibrato generator system. Thus a vibrato can be applied to only preselected octaves. The same signals can be used to vary the vibrato frequency and vibrato modulation depth as a function of the octave or note select signals.

Figure 6:
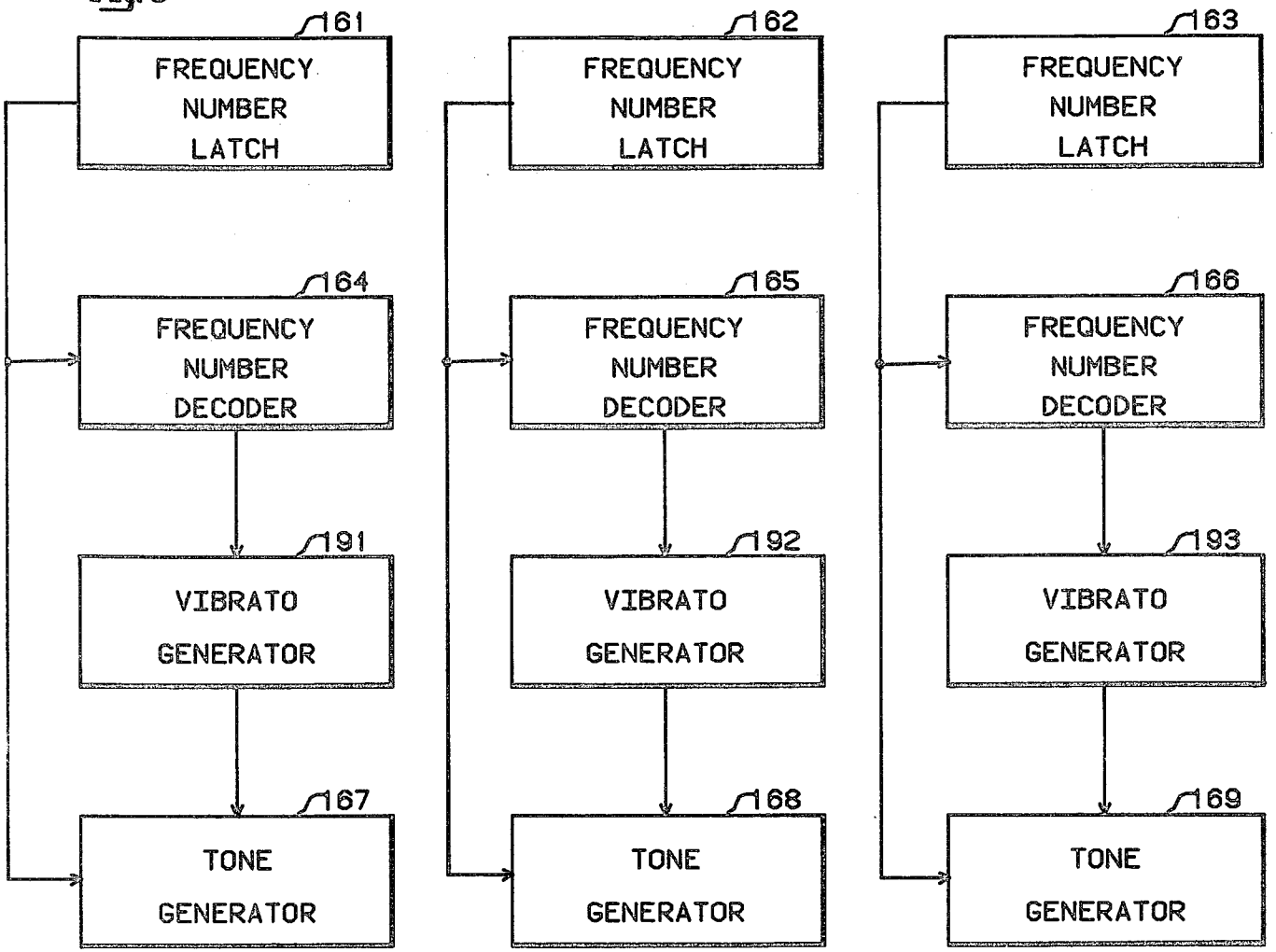
FIG. 6 is a schematic diagram of a vibrato select system.

FIG. 6 shows an implementation using the present invention whereby a vibrato effect is applied to tones lying in preselected octaves or within preselected intervals of the keyboard. As a general rule it is musically effective to eliminate a vibrato for low frequency notes such as those in the range of $C_2$–$B_2$. It is also desirable to eliminate a vibrato for high frequency notes such as those in the range of $C_6$–$C_7$. The note range signals produced by the set of frequency number decoders 164–166 can easily be used to operate the set of vibrato generators 191–193 only for notes that lie in the range of $C_3$–$B_5$.

The octave select signal or the note range signals can also be used to control the speed of the ADSR envelope generators that are an element of the tone generators. Using these select signals the attack timing can be made to be slow at the lower octaves and increase for the higher octaves.

Figure 7:
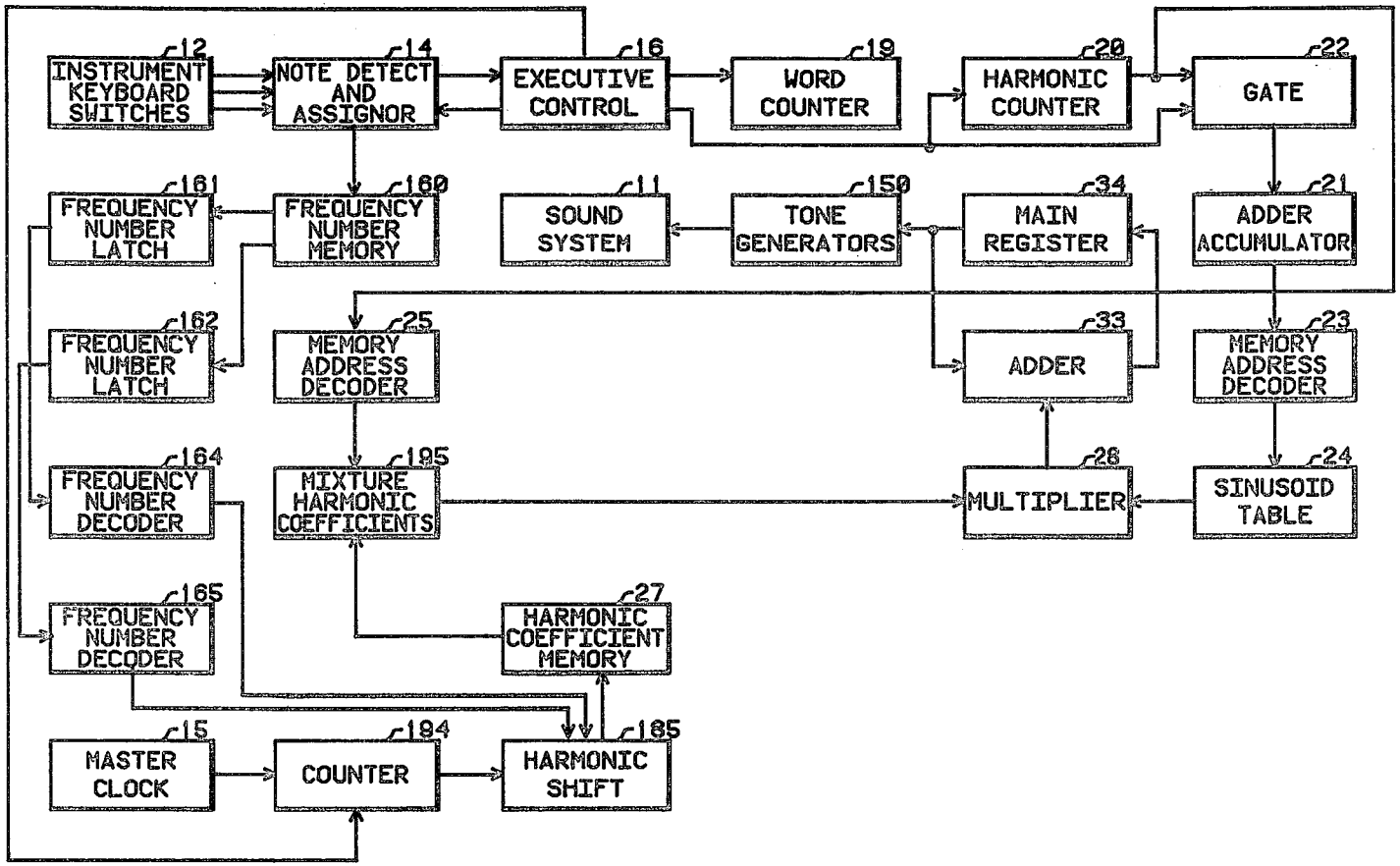
FIG. 7 is a schematic diagram of an alternative embodiment of the invention.

FIG. 7 shows an alternative embodiment of the present invention in which the tone color is changed in a preselected fashion as a function of the octave, or note range, in which a keyswitch is actuated using only a single stored set of harmonic coefficients. One application for the alternative system shown in FIG. 7 is to generate a mixture voice which is an essential tone constituent of an instrument designed for the rendition of concert and liturgical music.

Figures 8, 11:
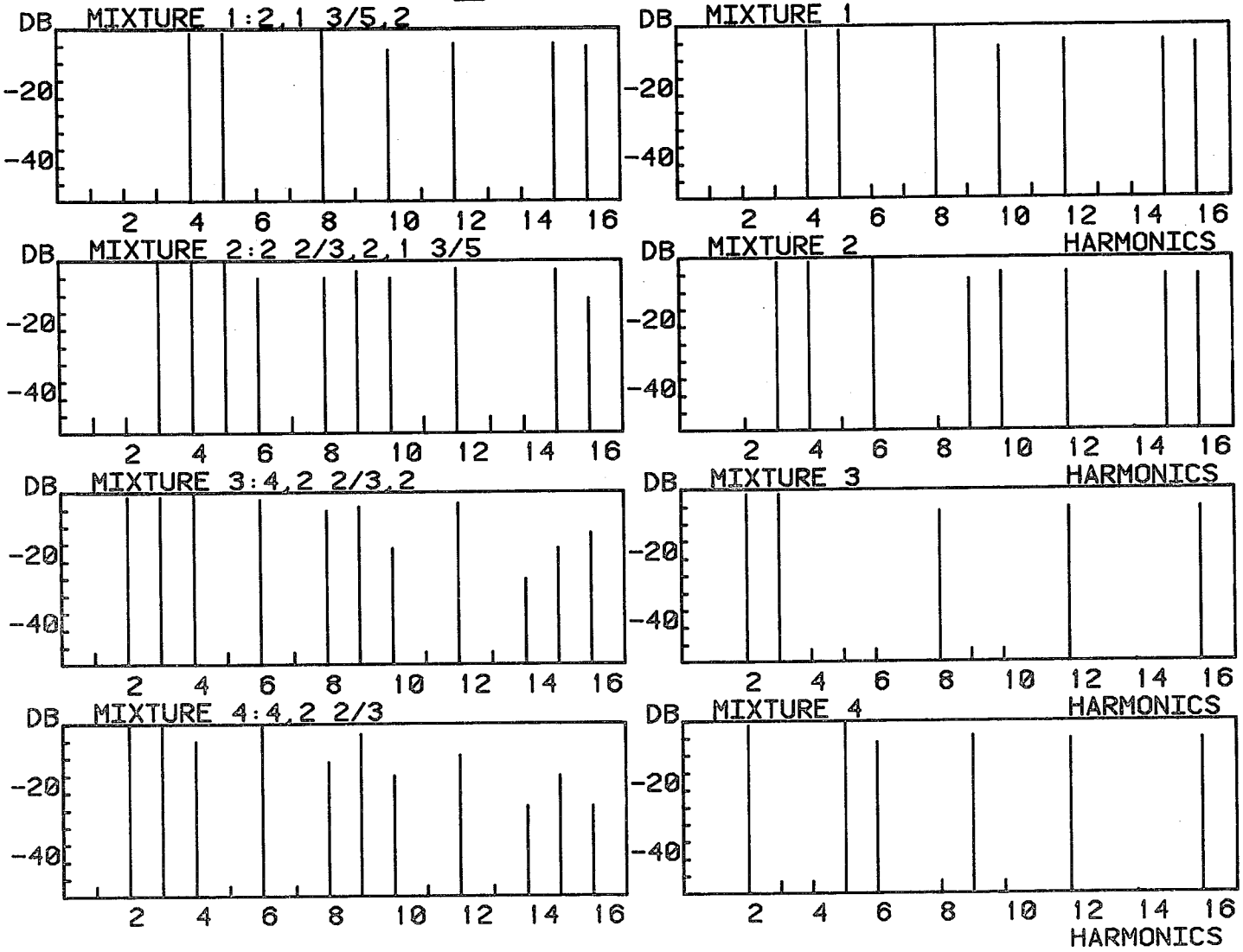
FIG. 8 shows a mixture spectral components.
FIG. 11 illustrates the mixture spectra generated by the alternate system embodiment.
Figure 9:
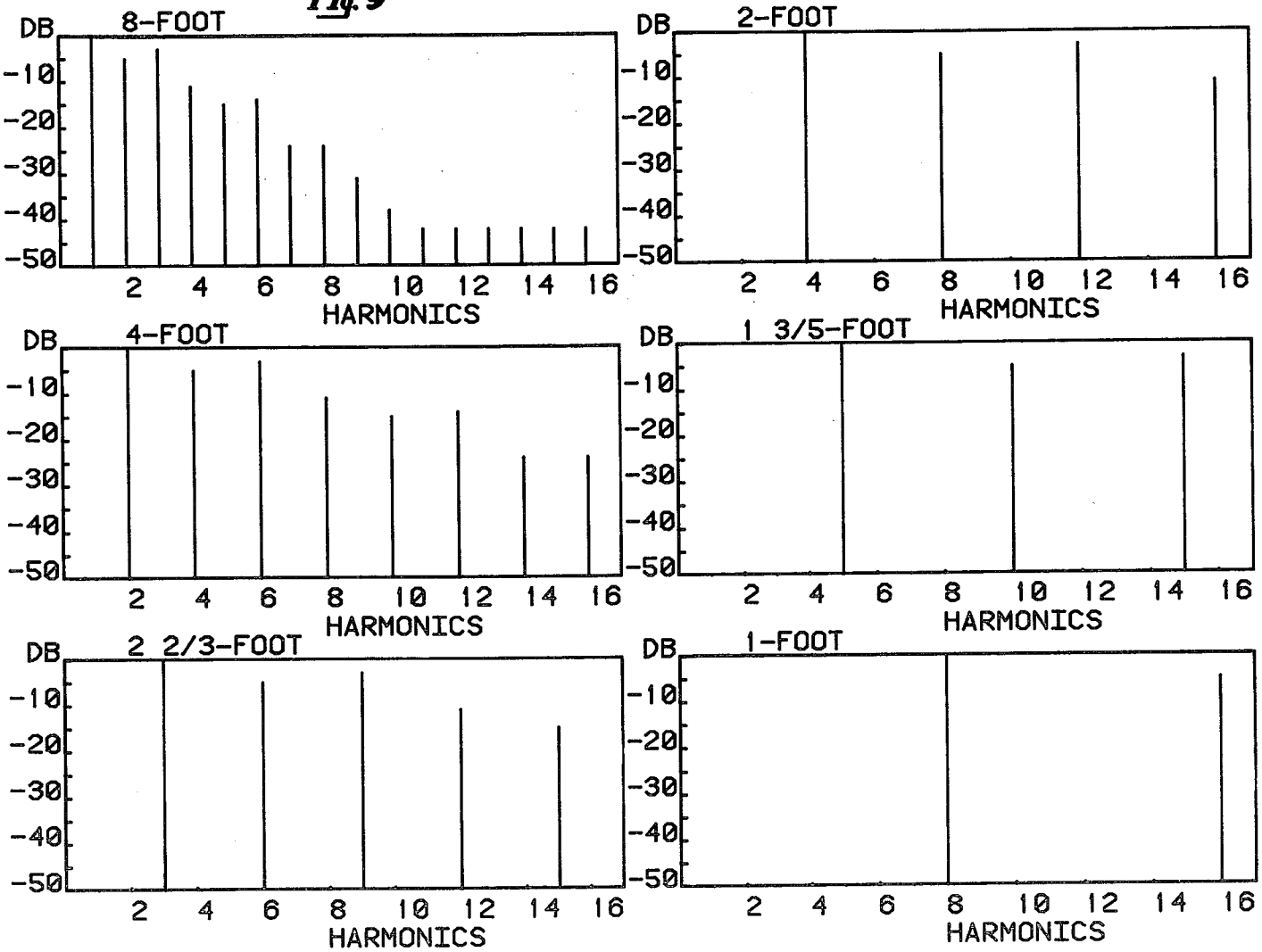
FIG. 9 shows the spectra for diapason type voices at selected footages.

FIG. 8 shows a typical spectra for a mixture stop. This mixture is generated by using a set of diapason pipes, or tones, having the spectral responses shown in FIG. 9 for the 8', 4', 2⅔', 2', 1 3/5', and 1' pitches. In an electronic instrument design, the 4-foot diapason spectrum is obtained from the basic 8-foot diapason spectrum by making a harmonic transformation in which even harmonics of the 4-foot tone are equal to the components for twice the harmonic number of each 8-foot harmonic spectral component. Thus the second harmonic of the 4-foot tone is equal to the first harmonic of the 8-foot tone; the fourth harmonic of the 4-foot tone is equal to the second harmonic of the 8-foot tone; and so on. All the odd harmonic components of the 4-foot tone are given a −50db value. The 2⅔-foot diapason spectrum is obtained by multiplying each of the 8-foot harmonic numbers by 3 and placing the results at the harmonic sequence 3,6,9,12,15, . . .,30. All the other harmonics for the 2⅔-foot tone are given a −50db value. The 2-foot tone harmonics are obtained by multiplying the 8-foot harmonic numbers by four and placing the results at the harmonic sequence 4,8,12,. . .,32. The 1 3/5- foot tone harmonics are obtained by multiplying the 8-foot harmonic numbers by five and placing the results at the harmonic sequence 5,10,15,. . .,30. The 1-foot harmonics are obtained by multiplying the 8-foot harmonic numbers by eight and placing the results at the harmonic sequence 8,16,24,32.

The spectra for the mixtures shown in FIG. 8 are for a typical mixture called a "four rank mixture." The top spectra for mixture 1 is obtained by adding the four indicated footages of 1',2',1 3/5' and 2'. This mixture 1 combination is usually used for the lowest octave on note sequence region.

The next higher octave, or note region, uses the mixture 2 which is composed of the combination of tones at the 2',2⅔',2', and 1 3/5' pitches.

The next higher octave, or note region, uses the mixture 3 which is composed of the combination of tones at the 4',2⅔' and 2' pitches.

The highest octaves, or note region, uses the mixture 4 which is composed of the combination of tones at the 4' and 2⅔' foot pitches.

The system shown in FIG. 7 generates a tone structure for a mixture stop using a single set of stored harmonic coefficients stored in the harmonic coefficient memory 27. The generated tone structure is very close to that for the various 4-rank mixtures shown in FIG. 8.

The harmonic coefficients corresponding to the spectra labeled mixture 1 in FIG. 8 are stored in the harmonic coefficient memory 27. The number values of the harmonic coefficients are calculated from the harmonic spectral values by the relation $$C_n = S \exp(-0.11512d\ db_n) \qquad \text{Eq. 1}$$

where n is the harmonic number, $db_n$ is the spectral strength of the n'th harmonic measured in db, and S is a preselected constant scale factor. The spectra labeled mixture 1 in FIG. 8 is a composite of the addition of diapason tones at 1,2,1 3/5, and 2 foot pitches.

At the start of each computation cycle, a coefficient evaluation cycle is initiated by the executive control 16. The counter 194 is reset to its minimal count state by the executive control 16 at the start of a coefficient evaluation cycle. The counter 194 is incremented by the timing signals provided by the master clock 15.

In response to the count state of the counter 194, the harmonic shift 185 accesses out harmonic coefficients from the harmonic coefficient memory 27. At the end of the coefficient evaluation cycle, a computation cycle is initiated. The computation cycle is implemented in the manner previously described for the tone generation system with the modification that the memory address decoder 25 now accesses harmonic coefficients from the mixture harmonic coefficients 185 which are provided as one of the data inputs to the multiplier 28.

If the output from a frequency number decoder, such as frequency number decoder 164, corresponds to a keyboard switch actuated in the first note region, then the harmonic shift 185 reads out harmonic coefficients from the harmonic coefficient memory 27 in response to the count state of the counter 194. If the output from a frequency number decoder corresponds to a keyboard switch actuated in the M'th note region then the harmonic shift 185 will address out harmonic coefficients from the harmonic coefficient memory at an address corresponding to the count state of the counter 194.

Figure 10:
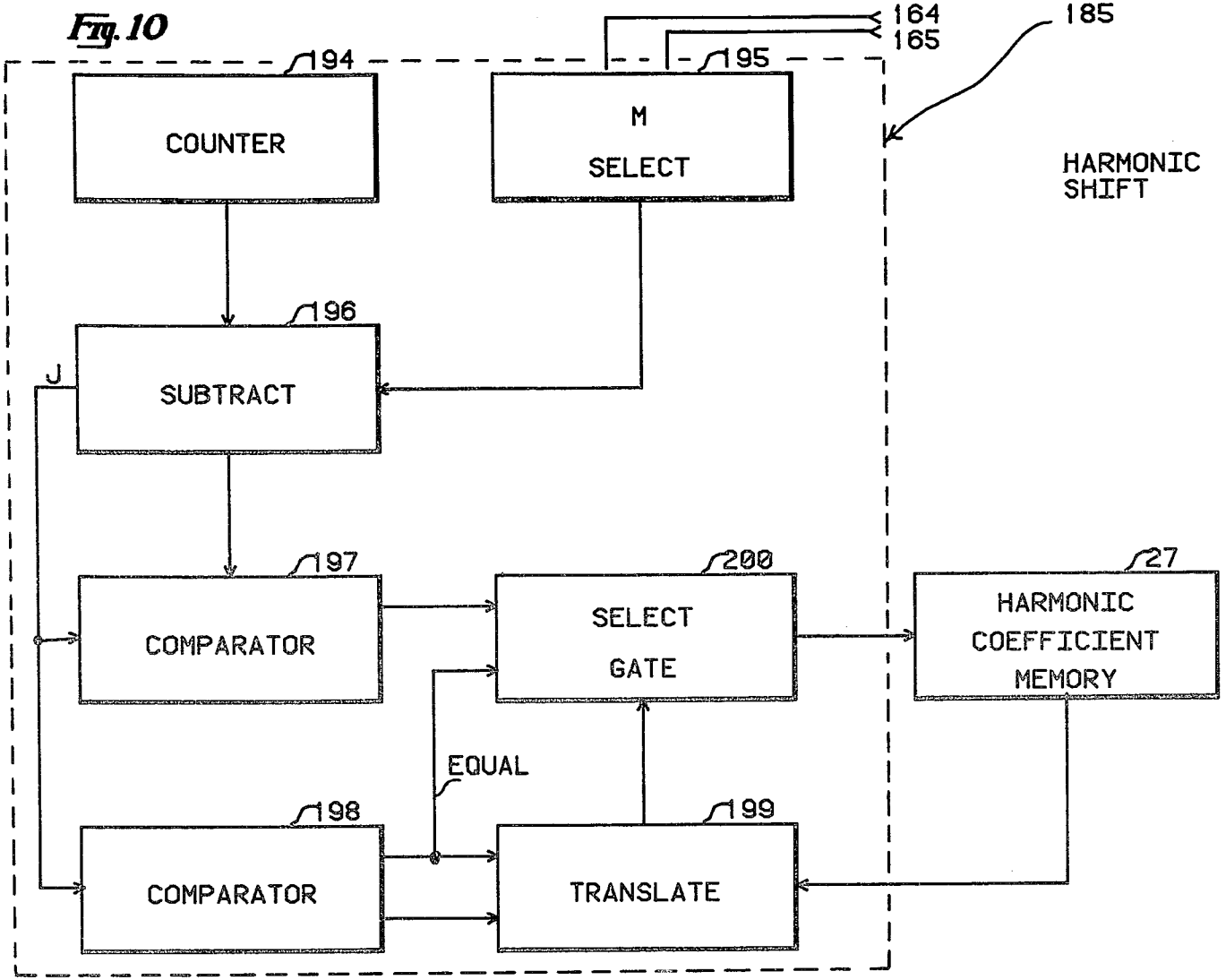
FIG. 10 is a schematic diagram of the harmonic shift 185.

FIG. 10 is a schematic diagram of the harmonic shift 185. A value of a constant M is selected from the M select 195 in response to the note range signal furnished by a frequency number decoder. M is usually equal to the note range number. The subtract 196 subtracts the value of M from the count state of the counter 194. The output K of the comparator 197 will be equal to J if J is greater than 1 and will be K=3 if J is equal to or less than 1. The comparator 198 will generate and EQUAL signal if J is equal to any of the values 7,11,13, and 14.

If the EQUAL signal is generated, then the select gate will transfer the value produced by the translate 199 to address harmonic coefficients from the harmonic coefficient memory 27. If the EQUAL signal is not generated, then the output from the comparator 197 is used to address harmonic coefficients from the harmonic coefficient memory 27. The translate 199 is implemented as an adressable memory so that if the EQUAL signal is generated, then the values shown in Table 3 are implemented.

TABLE 3

| J | Output Value |
|---|---|
| 7 | 6 |
| 11 | 10 |
| 13 | 12 |
| 14 | 12 |

The mixture harmonic coefficient 195 is implemented so that a constant coefficient value is always present for the 16th harmonic which otherwise might be eliminated by the harmonic shift 185. A suitable value for the 16th harmonic is 8.77S or −5db.

FIG. 11 illustrates the four mixtures generated for four note regions.

The tone generation system shown in FIG. 7 is readily extended to other variations in which a single set of harmonic coefficients are shifted in harmonic number and wherein a harmonic translation system logic is employed to eliminate certain harmonic components.

The present invention can also be incorporated into other tone generators of the type that synthesize musical waveshapes by implementing a Fourier-type transformation employing a selected set of harmonic coefficients. A system of this type is described in U.S. Pat. No. 3,809,786 entitled "Computor Organ." This patent is hereby incorporated by reference.

Figure 12:
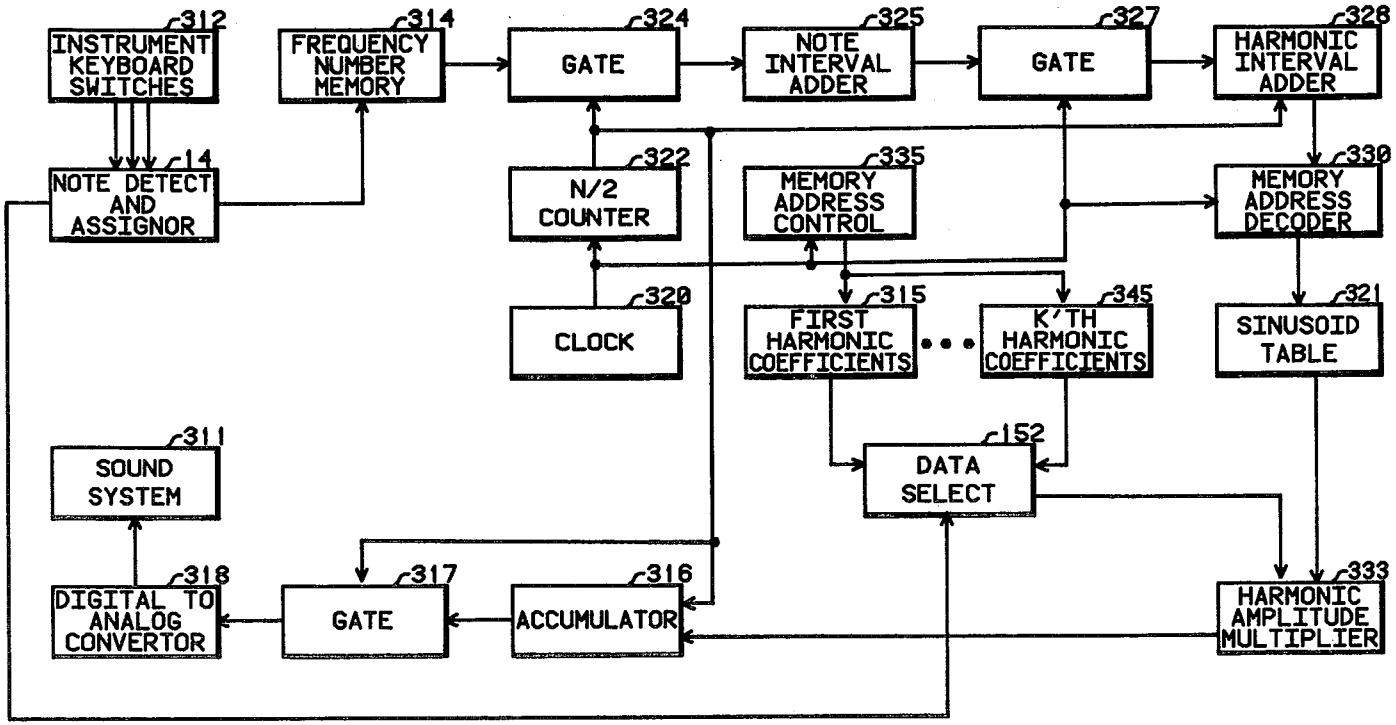
FIG. 12 is a second alternative embodiment of the invention.

FIG. 12 illustrates a tone generator system which incorporates the present invention into the Computor Organ described in the referenced patent. The system blocks shown in FIG. 12 are numbered to be 300 plus the corresponding block numbers shown in FIG. 1 of the referenced patent.

A closure of a keyswitch contained in the instrument keyboard switches 312 causes a corresponding frequency number to be accessed out from the frequency number memory 314. The accessed frequency number is added repetitively to the contents of the note interval adder 325. The contents of the note interval adder 325 specifies the sample point at which a waveshape amplitude value is calculated. For each sample point, the amplitude of a number of harmonic components are calculated individually by multiplying harmonic coefficient values furnished by the data select 152 by trigonometric sinusoid values read out from the sinusoid table 321. The harmonic component amplitudes are summed algebraically in the accumulator 316 to obtain the net amplitude at a sample point. The sample point amplitudes are converted into an analog signal by means of the digital-to-analog convertor 318 and then furnished to the sound system 311.

The sinusoid table 321 stores values of the trigonometric function $\sin(2\pi n/64)$. These values correspond to a waveshape having 64 points per period for the highest fundamental frequency musical pitch generated by the system.

The set of harmonic coefficient memories 315–315K and the data select 152 operate in the fashion previously described for the tone generation system shown in FIG. 1.

I claim:

1. In a keyboard musical instrument having a keyboard array of keyswitches arranged in musical octave groups, in which a plurality of data words corresponding to the amplitudes of points defining the waveform of a musical tone for one period are computed during a computation cycle and converted into musical waveshapes, apparatus for generating frequency dependent musical effects comprising:

a keyswitch state detect means wherein a detect signal is generated in response to each actuated keyswitch in said keyboard array of keyswitches a note range select signal generator responsive to said detect signal wherein a note range signal is generated, a waveshape memory means, a means for computing responsive to said note range signal whereby said plurality of data words corresponding to said amplitudes of points defining the waveform of a musical tone for one period are computed and stored in said waveshape memory means during a computation cycle, a first addressing means for sequentially reading out data words stored in said waveshape memory means, and a means for producing musical tone from data words read out from said waveshape memory means thereby generating said frequency dependent musical effects.

2. In a musical instrument according to claim 1 wherein said keyswitch state detect means comprises;

a keyswitch encoding means whereby said detect signal is encoded to designate the musical octave corresponding to said actuated keyswitch.

3. In a musical instrument according to claim 2 wherein said note range select signal generator comprises;

a decoding means responsive to said encoded detect signal wherein said note range signal is selectively generated from a plurality of note range signals each of which corresponds to one of said musical octave groups.

4. In a musical instrument according to claim 3 wherein said means for computing comprises;

a plurality of coefficient memories each of which stores a set of harmonic coefficients, a second addressing means for reading out said set of harmonic coefficients from each of said plurality of coefficient memories, a data select means responsive to said note range signal whereby one of said read out set of harmonic coefficients is selected, and a waveshape generator means responsive to said selected set of harmonic coefficients whereby said plurality of data words corresponding to said amplitudes of points defining the waveform of a musical tone are computed and stored in said waveform memory means during said computation cycle.

5. In a musical instrument according to claim 4 wherein said waveshape generator means comprises;

a logic clock means for providing logic timing signals, a word counter for counting said logic timing signals modulo the number of said plurality of data words stored in said waveshape memory means, a harmonic counter incremented each time said word counter returns to its minimal count state, an adder-accumulator means wherein the count state of said harmonic counter is successively added to the content of an accumulator in response to said logic timing signals and wherein the content of said accumulator is initialized to a zero value at the start of a computation cycle, a sinusoid table storing a set of trigonometric function values, a sinusoid table addressing means responsive to the content of said adder-accumulator means for reading out a trigonometric function value from said sinusoid table, a multiplying means for multiplying said read out trigonometric function value by one of said read out set of harmonic coefficients to form an output product data value, and a means for successively summing said output product data value with data words read out from said waveshape memory means and whereby the summed value is stored in said waveshape memory means.

6. In a musical instrument according to claim 2 wherein said note range select signal generator comprises;

a frequency number means for generating a frequency number in response to said detect signal, and a frequency number decoder means wherein said note range signal is generated in response to said generated frequency number.

7. In a musical instrument according to claim 2 wherein said note range select signal generator comprises;

a frequency number memory means for storing a plurality of frequency numbers, a frequency addressing means responsive to said detect signal whereby a corresponding frequency number is read out from said frequency number memory means, and a frequency number decoder means wherein said note range signal is generated in response to said frequency number read out from said frequency number memory means.

8. In a musical instrument according to claim 6 wherein said frequency number decoding means comprises;

a plurality of comparator means, each of which is associated with a preselected group of contiguous keyswitches contained in said keyboard array of keyswitches, and wherein an equal signal is generated from at least one of said plurality of comparator means in response to said generated frequency number, and a comparison select signal means responsive to each said generated equal signal whereby said note range signal to generated.

9. In a musical instrument according to claim 8 wherein said plurality of comparator means comprises;

a plurality of frequency number scalers each of which scales the magnitude of said generated frequency number by a corresponding preselected plurality of scale factors, and a plurality of number comparison means, each of which is associated with a corresponding one of said plurality of frequency number scalers, wherein each of said number comparison means generates said equal signal in response to its associated scaled magnitude of said generated frequency number if the magnitude of the difference between said scaled magnitude and a preselected frequency comparison number is less than a preselected comparison accuracy number.

10. In a musical instrument according to claim 9 wherein said comparison select signal means comprises;

priority select logic responsive to each equal signal generated by said plurality of comparator means whereby the equal signal generated by the comparator associated with the group of keyswitches corresponding to the highest musical notes is selected to generate said note range signal.

11. In a musical instrument according to claim 3 wherein said means for computing comprises;

a first harmonic coefficient memory means for storing a set of harmonic coefficients, a second harmonic coefficient memory means for storing data to be thereafter read out, a harmonic shift means responsive to said note range signal whereby harmonic coefficients are selectively read out of said first harmonic coefficient means and stored in said second harmonic coefficient memory means, and a waveshape generator means responsive to said data stored in said second harmonic coefficient memory means whereby said plurality of data words corresponding to said amplitudes of points defining the waveform of a musical tone are computed and stored in said waveform memory means during said computation cycle.

12. In a musical instrument according to claim 11 wherein said harmonic shift means comprises;

a shift addressing means for generating a sequence of consecutive memory address numbers in which the initial number of said sequence is selected in response to said note range signal, and a harmonic translator responsive to harmonic coefficients read out of said first harmonic coefficient memory whereby preselected memory address numbers are translated to corresponding translated address numbers.

13. In a keyboard musical instrument having a keyboard array of keyswitches arranged in musical octave groups, in which a plurality of data words are computed at regular time intervals and converted into musical waveshapes and wherein each said data word corresponds to a combination of a number of tone generators, apparatus for generating frequency dependent musical effects comprising;

a keyswitch state detect means wherein a detect signal is generated in response to each actuated keyswitch in said keyboard array of keyswitches, a note range select signal generator responsive to said detect signal wherein a note range signal is generated, a plurality of coefficient memories each of which stores a set of harmonic coefficient values, a select means responsive to said note range signal whereby a set of harmonic coefficient values is read out from one of said plurality of coefficient memories, a means for computing responsive to said read out set of harmonic coefficient values for computing at regular time intervals a sequence of data words each of which corresponds to said combination of a number of tone generators, and a means for producing musical waveshapes from said sequence of data words thereby generating said frequency dependent musical effects.

14. In a musical instrument according to claim 13 wherein said means for computing comprises;

a musical effects generating means responsive to said note range signal.

15. In a musical instrument according to a claim 14 wherein said musical effects generating means comprises a vibrato generator for selectively applying vibrato to said musical waveshapes.

* * * * *